United States Patent [19]

Furney, Jr. et al.

[11] 3,996,075

[45] * Dec. 7, 1976

[54] METHOD FOR MAKING A HEAT TREATED ALUMINUM ALLOY ARTICLE

[75] Inventors: Charles P. Furney, Jr., Delmont; Richard Couchman, New Kensington, both of Pa.

[73] Assignee: Aluminum Company of America, Pittsburgh, Pa.

[ * ] Notice: The portion of the term of this patent subsequent to Nov. 26, 1991, has been disclaimed.

[22] Filed: Oct. 31, 1974

[21] Appl. No.: 519,689

Related U.S. Application Data

[63] Continuation-in-part of Ser. No. 393,954, Sept. 4, 1973, Pat. No. 3,850,705.

[30] Foreign Application Priority Data

Aug. 14, 1974 United Kingdom ..... 35830/74

[52] U.S. Cl. ..... 148/13.1; 148/2; 148/3; 148/12.7 A; 148/159

[51] Int. Cl.[2] ..... C22F 1/04

[58] Field of Search ..... 148/13.1, 11.5 A, 12.7, 148/159, 2, 3

[56] References Cited

UNITED STATES PATENTS 3,850,705 11/1974 Furney et al. ..... 148/13.1

FOREIGN PATENTS OR APPLICATIONS 343,523 7/1918 Germany 71,953 8/1916 Switzerland

*Primary Examiner*—R. Dean

*Attorney, Agent, or Firm*—Daniel A. Sullivan, Jr.

[57] ABSTRACT

A method for making a heat treated aluminum alloy article, including the steps of bonding insulation onto selected areas of the article with a bonding means for maintaining a bond during heating for solution heat treatment, solution heat treating the thus-insulated article, and, with the insulation still on the article, subjecting the solution heat treated article to a quench for maintaining precipitable components of the alloy in solution and, subsequent to the quench, age-hardening the article.

9 Claims, 15 Drawing Figures

METHOD FOR MAKING A HEAT TREATED ALUMINUM ALLOY ARTICLE

Cross-Reference to Related Application

This is a continuation-in-part of application Ser. No. 3,393,954, filed Sept. 4, 1973, now Pat. No. 3,850,705.

Background of the Invention

The present invention relates to the manufacture of aluminum alloy articles, and, more particularly to the manufacture of aluminum alloy articles exhibiting less warpage or tendency to warp.

If an aluminum forging having web sections surrounded by ribs is quenched after solution heat treatment and the web sections are then machined to a reduced thickness, a phenomenon called "oil-canning" may occur in which the web section may suddenly or slowly deflect away from the cutting tool. Deflection may also be toward the cutting tool, and this can result in a gouging or tearing of the web section. The metal deflection is much like that occurring on the bottom of an oil can when the bottom is being worked for dispensing oil onto an area to be lubricated - thus the term "oil-canning". Oil-canning can make it impossible to achieve desired thinness or tolerance in a production part.

In general, the solution heat treatment plus quenching of e.g. forged, cast, and extruded aluminum alloy articles can lead to warpage or tendency to warp (the tendency being noticed e.g. during machining).

Summary of the Invention

In view of the above, it is an object of the present invention to provide a method for making heat treated aluminum alloy articles, which method allows in general the production of articles exhibiting less warpage or tendency to warp, with a minimum reduction of strength such that in most cases the strength will exceed normal specifications.

Another object of the present invention is to provide a method for manufacturing aluminum alloy forgings exhibiting upon machining reduced oil-canning in oil-canning susceptible sections.

It is a further object of the present invention to provide such a method having the additional advantage of reducing overall warpage in such forgings.

Yet another object of the invention is to provide a method for making heat treated aluminum forgings, extrusions, and castings, which method allows in general the production of articles exhibiting less warpage or tendency to warp.

These as well as other objects, which will become apparent in the discussion that follows, are achieved according to the present invention by a method for making a heat treated aluminum alloy article, including the steps of bonding insulation onto selected areas of the article with a bonding means for maintaining a bond during heating for solution heat treatment, solution heat treating the thus insulated article, and, with the insulation still on the article, subjecting the solution heat treated article to a quench for maintaining precipitable components of the alloy in solution, and, subsequent to the quench, age-hardening the article.

DESCRIPTION OF THE PREFERRED EMBODIMENTS A. The Drawings

Figure 1A:
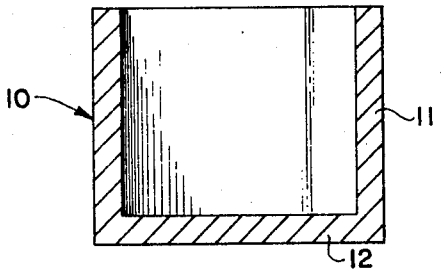
FIGS. 1A and 1B are elevational cross sections, the cutting planes for which contain vertical axes of cylindrical symmetry.
Figure 1B:
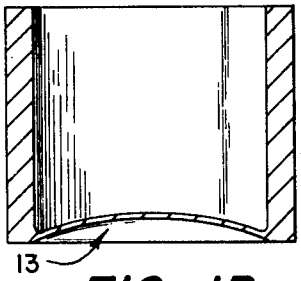

Referring now to FIG. 1A, there is shown a forging 10 formed by a cylindrical wall or rib section 11 and a base or web section 12. If forging 10 is provided in, for example, 7075 aluminum alloy with rib and web thicknesses of one inch, solution heat treated at 870° F, and quenched in water at 60 to 80° F, age-hardened at 250° F for 24 hours, and the lower side of web 12 in FIG. 1A is then gradually machined off, a certain web thickness is eventually reached at which web 12 suddenly becomes unstable and pops upwards in FIG. 1B, away from the cutting tool, into an "oil-canned" position 13.

It is known to reduce this oil-canning effect by, subsequent to the quenching, cooling forging 10 to minus 100° F and restriking forging 10 in the same die members originally used in its formation. The restriking causes a stretching of the ribs which places web 12 in tension.

Figure 2:
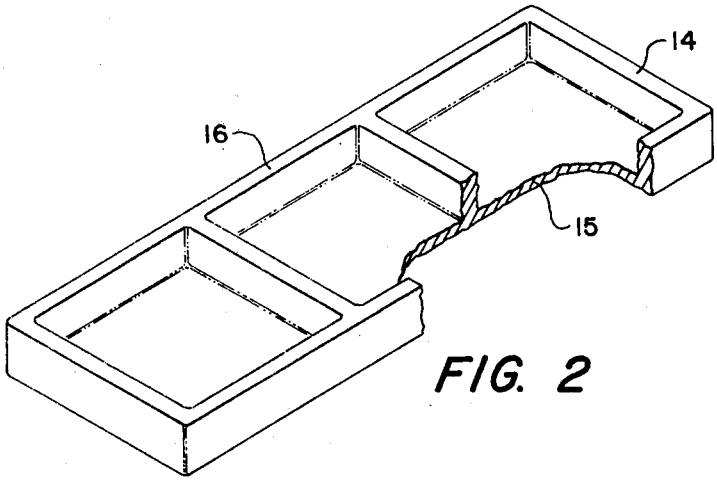
FIG. 2 is a perspective view of an aircraft forging with a portion broken away to reveal the relative position and thickness of its web sections.

FIG. 2 illustrates a ribbed and webbed forging of a precipitation hardenable alloy material. The design is such as may be used in airplane manufacture. As in FIGS. 1A and 1B, the ribs 14 and 16 are, in this example, only on one side of the webs 15. Typically, following forging and age-hardening, such a forging may be machined all around, including both sides of the webs, to tolerance. The problem of oil-canning can make it impossible to achieve a desired thinness within tolerance at desired strength levels and endangers the economic viability of aluminum alloy forgings for certain applications.

We have discovered that the provision of proper amounts of insulation on both sides of the webs of aluminum alloy forgings during quenching can reduce oil canning in the webs sufficiently to permit machining to tolerance, while nevertheless maintaining sufficient web hardenability in a precipitation hardening step following quenching. We have also discovered that the placing of such insulation operates to reduce overall warping of a forging.

Figure 3:
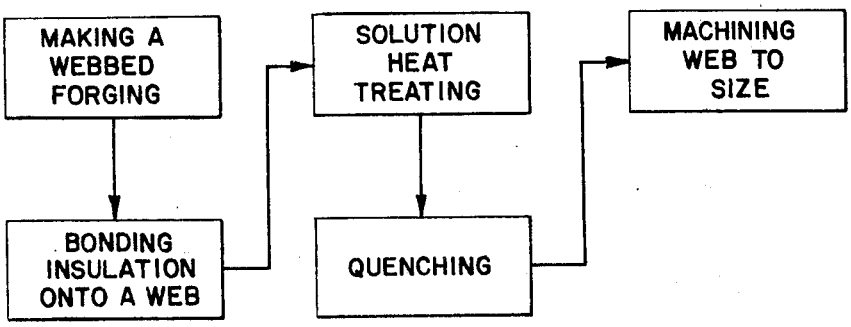
FIG. 3 is a process flow diagram.

A process according to the present invention is illustrated by s flow diagram in FIG. 3. First, a webbed forging is made, then insulation is bonded onto a web following which the forging is heated to the solution heat treatment temperature. With the insulation still on the web, the forging is quenched, for example, with water of temperature between 60 and 80° F. It is then possible to machine the web without experiencing unacceptable warping during machining to tolerance.

FIG. 3 is a flow diagram of only one embodiment of the present invention. Thus, for example, the forging may receive a preliminary machining before the step of bonding. Also, the forging may, for example, be age-hardened after the step of quenching and before the step of machining.

Figure 10:
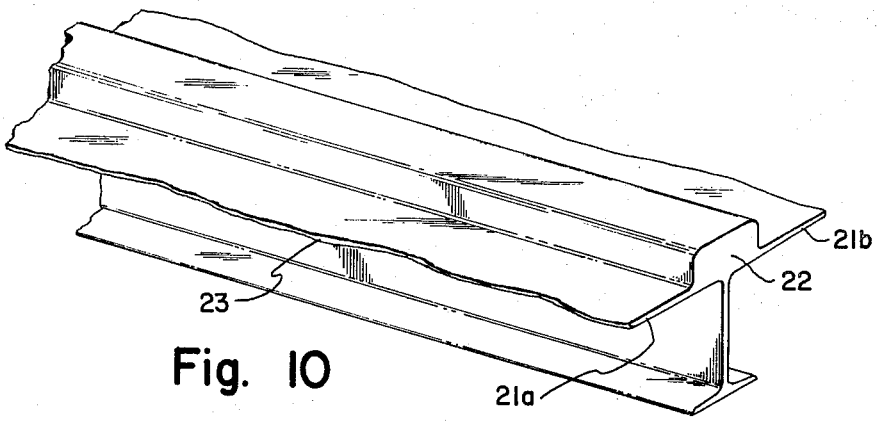
FIG. 10 is an isometric view of an extrusion.

FIG. 10 illustrates a precipitation hardenable aluminum alloy extrusion which has relatively thin, "wing" sections 21*a* and 21*b* adjoining a relatively thick, central section 22. If this extrusion is quenched from a solution heat treating temperature, it will typically bow upwards (center of curvature circle upwards in FIG. 10) and the wing sections will have waves 23 as shown. We have discovered that the provision of proper amounts of insulation on both the upper and lower sides of the wings during quenching can reduce or eliminate the occurrence of the waves 23. In spite of the treatment, there is little or essentially no reduction in wing hardenability for a precipitation hardening step following quenching. This is of particular advantage, because then stretching of the extrusion need only remove whatever bow there is in the quenched extrusion. When a part is stretched, it is work hardened, and there is, therefore, a limit to the amount of stretching that a part can undergo. There are cases in which the allowable amount of stretching is not enough to remove the edge wave. Use of the present invention at least cuts down on the amount of stretching that must be done to completely straighten the extrusion.

Figure 11:
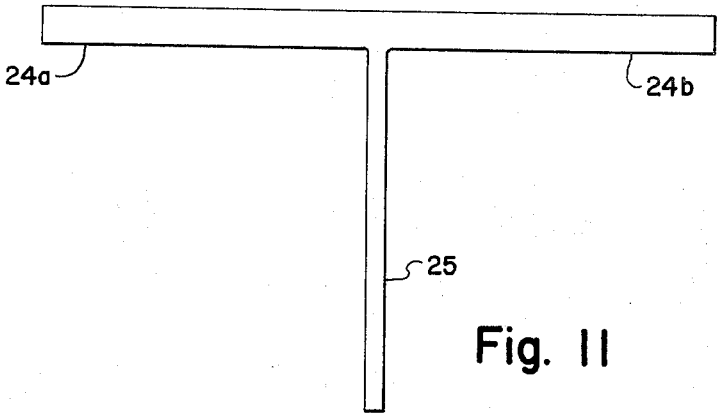
FIG. 11 is an end view of another extrusion.

FIG. 11 illustrates a precipitation hardenable aluinum alloy extrusion which has relatively thick flanges 24a and 24b and a relatively thin stem 25. If this extrusion is quenched from a solution heat treating temperature, it will typically bow upwards (axis of curvature cylinder horizontal and above flanges 24*a* and 24*b* in FIG. 11) and the stem 25 will have waves like waves 23 of FIG. 10. We have discovered that the provision of proper amounts of insulation on both the left and right sides of stem 25 in FIG. 11 during quenching can reduce or eliminate the occurrence of the waves in the stem, while nevertheless maintaining sufficient stem hardenability in a precpitation hardening step following quenching. Upon quenching after insulation is on stem 25, the extrusion can bow in the opposite direction to that mentioned above. By longitudinally stretching the extrusion of FIG. 11 after quenching, the bow in extrusion is removed.

The providing of insulation on stem 25 causes the extrusion of FIG. 11 to bow in the opposite direction, i.e. the axis of the curvature cylinder lies below flanges 24*a* and 24*b* of FIG. 11.

A particularly advantageous feature of the present invention has been discovered in connection with extrusions as in FIG. 11. In extruding a beam shaped as in FIG. 11, it is possible to experience recrystallization in stem 25, with minimal recrystallization in flanges 24*a* and 24*b*. The thinner, stem section reaches a higher temperature during the extrusion process. The amount of recrystallization occuring in stem 25 depends on parameters such as the extrusion conditions, e.g. extrusion rate and temperature and the metallurgical character of the metal, but if recrystallization is experienced in stem 25 and not in flanges 24*a* and 24*b*, this can so complicate the straightening of the extruded beam, following its quenching, that the obtaining of a straight beam by the inexpensive stretching technique will become difficult. It is believed that this is due to the fact that the recrystallized material has a lower yield strength than non-recrystallized material. It has been discovered that, because the application of the insulation on both sides of stem 25 causes the bow to occur in the opposite direction, it then becomes possible to stretch the beam so that the bow completely disappears, despite the presence of recrystallized material in stem 25.

For extrusions in general, the present invention is advantageous in that insulation can be painted onto relatively inaccessible areas.

Figure 12:
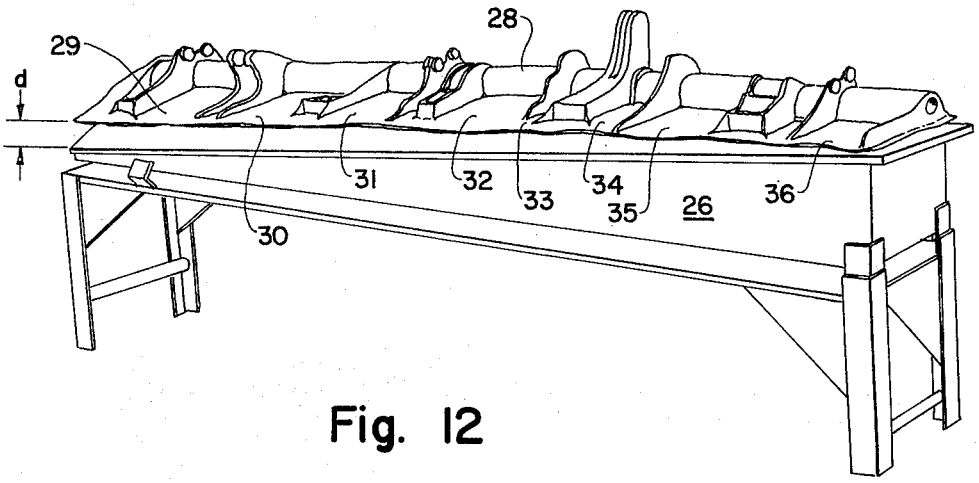
FIGS. 12 and 13 are perspective views of a casting.
Figure 13:
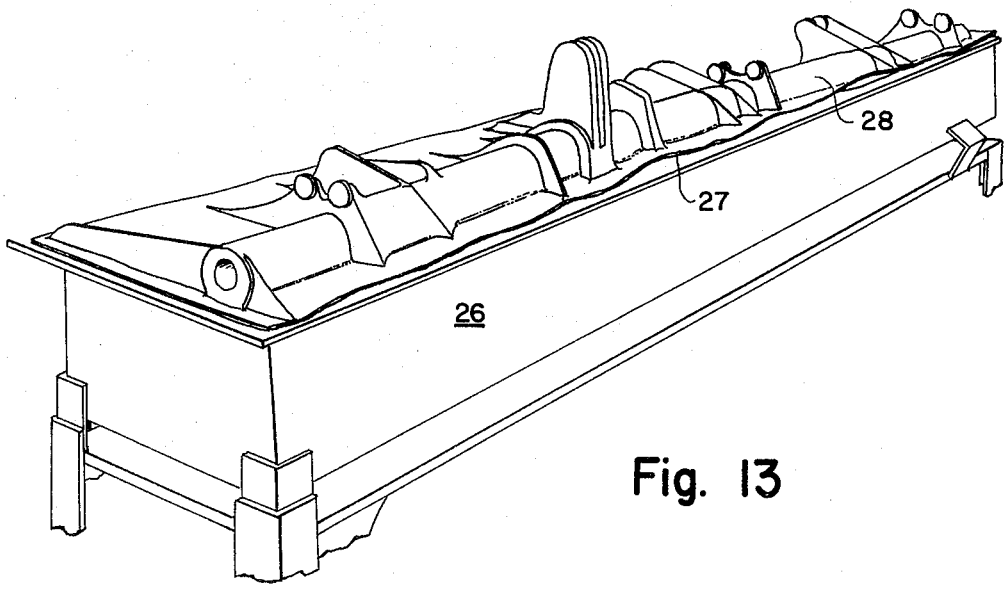

FIGS. 12 and 13 illustrate a precipitation hardenable aluminum alloy precision casting of length, for example, 75 inches. The casting was quenched from a solution heat treating temperature and became distorted in the manner shown. Thus, for example, with the first three corners of the casting held against the gage surface of gage box 26, the fourth corner was, for example, up off of the gage surface a distance *d* of around 4 inches, as shown in FIG. 12. Additionally, as shown in FIG. 13, the leading edge 27 became quite wavy. Another distortion notes was that the tube section 28, which is integrally cast on one side of the casting, became bent. Finally, oil-canning occurred in web areas 29–36. We have discovered that is possible, by the application of proper insulation on selected areas of this casting, to reduce or even eliminate completely these distortions. In determining which areas of the casting to insulate before quenching, the following shorthand way of thinking about the action of the present invention may be used: The application of insulation to some selected part of an article acts to shrink that part relative to other parts of the article during quenching. This casting had edge wave in edge 27. Edge wave is in effect the presence of too great a length of material, and this problem of edge wave in edge 27 was substantially reduced by applying insulation to both its upper and its lower side. Another of the distortions of this casting was that it had twisted to give an appreciable distance *d*. This distortion is believed related to the above-described oil-canning distortion and to be a result, in general, of material in the center of the article being in compression, with the part trying to relieve that compression by going into a twisted state. To substantially eliminate the twist distortion, web areas 29 through 36 were provided with insulation. For the purpose of trying to counteract the bend or bow in the tube 28, insulation was placed on the underside (with respect to the casting as shown in FIGS. 12 and 13), along the area of the tube wall. It is to be noted in this regard that the bow of tube 28 was about a cylindrical axis roughly running perpendicularly to the length of the casting and situated above the casting in FIGS. 12 and 13.

Figure 14:
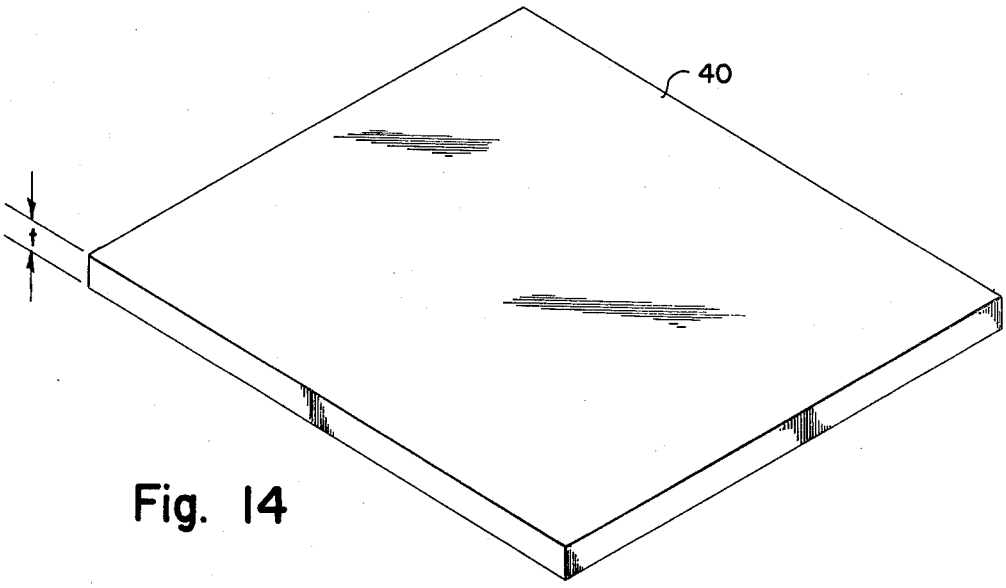
FIG. 14 is an isometric view of a plate.

With reference to FIG. 14, a precipitation hardenable aluminum alloy plate 40 having a thickness of two inches and residual stresses caused by quenching will curve if, for example, its top surfce is machined off. The concave side will be that which is machined off. According to the present invention, this tendency to curve, when the plate is machined later, following quenching, is reduced or eliminated by the provision of insulation on the side opposite that to be machined off.

If this plate 40 is machined on both sides, in varying amounts and configurations, it will become concave on the side which receives the most machining, and this tendency to curve may be reduced by providing insulation on the side that receives the least machining.

With further reference to FIG. 14, a thinner plate, e.g. of $t = ½$ inch, is provided with insulation on both sides before quench for the purpose of reducing the residual stress differential between the surface and the interior, so that it is less susceptible to distortion during later fabrication. Despite the reduced quench rate resulting from the insulation, adequate hardenability can nevertheless be obtained due to the thinness of the plate.

B. THE INSULATION

Insulation can be provided on the article in the form of a coating of a suitable cement. Another technique is to use the cement to bond an additional insulating material, such as glass cloth, to the article. Considerable perseverance was required to find satisfactory cements. Thus, we found that a number of cements, including sodium silicate, 85% phosphoric acid, a mixture of 40% of minus-325 tabular alumina and 60% of 85% phosphoric acid, and calcium aluminate cement, toether with a number of proprietary cements, would fall off of an article during its solution heat treatment in a furnace. Cements which were found to give best bonding are, firstly, Johns-Manville Fibrous Adhesive, a paintable mixture which gave on analysis, on a dry weight basis, essentially 80% sodium silicate (silicon to sodium weight ratio equals 2.1) and 20% asbestos fiber shorts and, secondly, Johns-Manville Fireite Cement, a paintable mixture, which gave on analysis, on a dry weight basis, essentially 2% asbestos fiber shorts, 15% kaolinite, 45% silica powder, remainder sodium silicate of silicon to sodium weight ratio equal to 1.4. Percentages are on a weight basis. Asbestos fiber shorts are asbestos material whose fibers have lengths below approximately 1 millimeter. Good bonding was achieved with Sauereisen No. 31 cement available commercially from the Sauereisen Cements Company. Poor bonding was exhibited by Saureisen No. 1 cement.

Besides insulating just with cement material itself, the cement material may be used to bond, for example, glass cloth in place on articles to act as insulation. Exemplary glass cloth suitable in the practice of the present invention is a cloth having a weave of 16 filaments by 14 filaments, a thickness of 0.0138 inches, and a weight of 9.55 ounces per square yard available commercially as Burlington Industries glass cloth No. 7500, a 42 × 32 weave of 0.0070 inch thickness and 5.95 per square yard weight available commercially as Burlington Industries glass cloth No. 1528, and a glass cloth of weave 32 × 29, 0.0060 inch thickness, and 4.90 ounces per square yard weight available as Burlington Industries glass cloth No. 1510.

For any given article, it is possible without undue experimentation to arrive at a proper amount of insulation for reducing warpage or tendency to warp while nevertheless obtaining sufficiently high mechanical properties, for example, yield strength. However, choice of the correct amount of insulation can be helped by engineering analysis as follows, according to another feature of the present invention.

C. ANALYSIS

One first chooses a yield strength $\sigma$ which he is willing to accept in the section to be insulated. A suitable quench to achieve this yield strength is determined by use of the following equations:

$$\sigma = \sigma_{max} \exp\left[\ln \frac{\sigma_x}{\sigma_{max}} \tau\right] \tag{1}$$

$$\tau = \int_{t_0}^{t_f} \frac{dt}{C_{\sigma_x}(T)} \tag{2}$$

These equations and their use will become clear from the following discussions of their theory.

C.1 THEORY

This theory is taken from work of J. T. Staley and J. W. Evancho.

By considering kinetics of precipitation it is possible to predict more accurately the effects of precipitation during the quench on properties, regardless of the shape of the cooling curve. Isothermal precipitation kinetics for aluminum alloys are defined by the equation:

$$\zeta = 1 - exp\,(-t/k),$$

where: $\zeta$ = fraction transformed, $k$ = temperature dependent constant which is proportional to the time required to precipitate a constant amount of solute, $t$ = time.

The value of the constant $k$, and hence precipitation rate, depends principally on the degree of supersaturation and the rate of diffusion. It can be estimated using a reciprocal form of an equation describing nucleation rate that:

$$k = \frac{C_t}{K_1} = K_2 \exp \frac{K_3 K_4^2}{RT(K_4 - T)^2} \exp \frac{K_5}{RT}, \tag{4}$$

where:

$C_t$ = critical time required to precipitate a constant amount (the locus of the critical times is the C-curve), $K_1$ = constant which equals the natural logarithmm of the fraction untransformed (1 - fraction defined by the C-curve), $K_2$ = constant related to the reciprocal of the number of nucleation sites, $K_3$ = constant related to the energy required to form a nucleus, $K_4$ = constant related to the solvus temperature, $K_5$ = constant related to the activation energy for diffusion, R = gas constant, 8.3143 $J \cdot K^{-} \cdot mol^{-}$, T = temperture degrees K.

See J. W. Cahn, Acta. Met., 1956, V. 4, pp. 449-447. Consequently, equation (3) can be rewritten as:

$$\zeta = 1 - \exp\left(\frac{K_1 t}{C_t}\right). \tag{5}$$

Using this model for isothermal precipitation, fraction of solute precipitated during the quench can be calculated. Cahn has shown, for transformations where reaction rate is a function only of the amount transformed and temperature, that a measure of the amount transformed during continuous cooling is given by the integral:

$$\int_{t_o}^{t_f} \frac{dt}{C_t(T)} = \tau, \quad (6)$$

where:

$\tau$ = quench factor, t = time from the cooling curve, $t_o$ = time at the start of the quench, $t_f$ = time at the end of the quench, $C_t$ (T) = critical time from the C-curve. See J.W. Cahn, Acta. Met., 1956, V. 4, pp. 572-575.

Precipitation kinetics on continuous cooling, therefore, can be expressed by the equation:

$$\zeta = 1 - (K_1\tau), \quad (7)$$

where $\tau$ substitutes for $t/C_t$ in Equation (5). When $\tau = 1$, the fraction transformed, $\zeta$, equals the fraction transformed designated by the C-curve.

To predict yield strength, some knowledge of the relationship between extent of precipitation and loss in ability to develop property is required. Because attainable strength of precipitation-hardenable aluminum alloys is a function of the amount of solute remaining in solid solution after the quench, Equation (3) can be expressed as:

$$\frac{\sigma - \sigma_{min}}{\sigma_{max} - \sigma_{min}} = \exp(-t/k), \quad (8)$$

where:

$\sigma$ = yield strength attained, $\sigma_{min}$ = annealed yield strength, $\sigma_{max}$ = maximum yield strength.

For high strength alloys, $\sigma_{min} << \sigma_{max}$, so Equation (8) can be approximated by:

$$\frac{\sigma}{\sigma_{max}} = \exp(-t/k). \quad (9)$$

By substituting the term $\sigma/\sigma_{max}$ for $(1-\zeta)$ in Equation (7), relationships between the yield strength attainable after continuous cooling, $\sigma$, and quench factor, $\tau$, can be expressed as follows:

$$\sigma = \sigma_{max} \exp(K_1\tau), \quad (10)$$

where: $\sigma_{max}$ = yield strength attainable with infinite quench rate, $K_1 = \ln \sigma_x/\sigma_{max}$, $\sigma_x$ = yield strength represented by the C-curve, and $$\tau = \int_{t_o}^{t_f} \frac{dt}{C_{\sigma_x}(T)}, \quad (11)$$

where: $t$ = time, $C_{\sigma_x}$ (T) = the C-curve for $\sigma_x$, i.e., critical time as a function of temperature in °Kelvin to reduce attainable strength to $\sigma_x$, $t_o$ = time at the start of the quench, $t_f$ = time at the end of the quench.

C-curves for yield strength can be determined from interrupted quench data using graphical analyses, but graphical methods suffer from the disadvantage that effects of precipitation during the quench to the intermediate temperature and from the holding temperature to room temperature are ignored. To eliminate this deficiency, a new method of determining C-curves from data obtained by either isothermal of nonisothermal precipitation was developed by Staley and Evancho. Using an iterative procedure, constants in the C-curve equation are determined to provide the best fit of the data to Equation (10).

Thus, after Cahn, Acta. Met., 1956, Vol. 4, pp. 449–457, the C-curve is expressed as a form of Becker's nucleation equation:

$$C_{\sigma_x} = K_1K_2 \exp \frac{K_3K_4^2}{RT(K_4 - T)^2} \exp \frac{K_5}{RT}, \quad (12)$$

where: $K_1 = \ln\left(\frac{\sigma_x}{\sigma_{max}}\right)$ $K_2$, $K_3$, $K_4$, and $K_5$ = constants $R$ = gas constant, 1.9872 cal/mole/° C $T$ = temperature in degrees Kelvin.

The values of the constants $K_2$ through $K_5$ may be determined empirically using the following steps: 1. Quench samples from the solution heat treatment temperature using techniques which provide a wide range in strength and apply appropriate precipitation heat treatment. 2. Determine either strength or hardness. 3. Select an arbitrary value for $\sigma_x/\sigma_{max}$. 4. Hypothesize values for $K_2$ through $K_5$. 5. Calculate quench factor $\tau$ for each sample making use of the quench curves, i.e., sample temperature as a function of time, occurring in step 1. 6. Fit data to $\sigma = \sigma_{max}\exp[\ln(\sigma_x/\sigma_{max})\tau]$ and determine residual errors. 7. Square the errors and sum. 8. Repeat steps 3–7 until the sum of the squared errors is minimized. The C-curve calculated is for the property level selected in step 3.

A computer program may be written to do the calculations. The ratio $\sigma_x/\sigma_{max}$, time-temperature data and property for each sample, and candidate values for $K_2$ ... $K_5$ are input. A quench factor $\tau$ for each sample is calculated, and regression and error analyses are made. Using the technique of pattern search, new constants are selected until the sum of the squared residuals is minimized. See D. J. Wilde, Optimum Seeking Methods, P. 145, Prentice-Hall Inc., Englewood Cliffs, New Jersey, 1964. Constants $K_2$ ... $K_5$ and $\sigma_{max}$ are output.

Staley and Evancho have applied the interrupted quenching data of Fink and Willey, Trans. AIME, 1948, Vol. 175, pp. 414–427, to determine C-curves for the strength of 7075-T6 sheet. The obtained C-curve for yield strength is given by the equation:

$$C_{\sigma_x} = -\ln(\sigma_x/\sigma_{max})\, 4.055 \times 10^{-13} \exp \frac{251.2(782.7)^2}{RT_K(782.7 - T_K)^2} \exp \frac{33{,}760}{RT_K}, \quad (13)$$

where $T_K$ is expressed in °K, $C_{\sigma_x}$ in seconds, and R = 1.9872 cal/mole/° K. The quench factor $\tau$ for each sample was calculated using times $C_{\sigma_x}$ given by Equation (13) when $\sigma/\sigma_{max} = 0.995$. Standard error of these data fitted to the equation:

$$\sigma = 72.42 \exp[0.005013\tau] \quad (14)$$

was 1.2%, where $\sigma$ is here calculated in kilopounds per square inch or ksi.

Where the material is 7075 alloy but the heat treatment conditions are not for the case of T6 sheet, but rather, for example, for the case of T73 forgings, only Equation (14) need be adjusted. The constants $K_1$ to $K_5$ remain the same. In the case of 7075-T73 aluminum forgings, $\sigma_{max}$ is about 63,600 psi, so that Equation (14) is altered only by having 63.6 ksi in place of 72.42 ksi.

After the constants in the C-curve are determined, predicting properties that would be developed in samples quenched in a hypothetical manner is straightforward. The quench factor $\tau$ is calculated using data taken from the postulated time-temperature curve to express Equation (13) in terms of t for the evalution of Equation (2). The calculated $\tau$ is then substituted in Equation (1). Conversely, given a desired yield strength for a web section, a quench factor $\tau$ appropriate to achieve the desired yield strength may be obtained from Equation (14). Then, a quench required to give the appropriate quench factor $\tau$ may be selected by experiment and Equation (2). In the experimentation, quench curves $T=f(t)$ are determined. For each quench curve, $C\sigma_x = 0.995\ \sigma_{max}$ (T) is expressed as $C(t)$. Then the integration of Equation (2) is performed to see if the desired quench factor $\tau$ results.

C.2. Surface Heat Transfer Coefficient

To further facilitate determining how to achieve a desired yield strength in some section of an article, one may work from the Biot Modulus. The classical theory for analyzing transient heat flow in plates (one-dimensional flow) allows one to estimate the transient conditions in webs, or similar sections, of aluminum forgings. The pertinent equations as developed by Kruth, "Principles of Heat Transfer", Chapter IV, pp. 127–150, are:

$$\frac{T(X,t)-T_F}{T_S-T_F} = \sum_{n=1}^{n=\infty} \exp\left(\frac{-\delta_n^2}{L^2}\alpha t\right)\left(\frac{\sin\delta_n \cos(\delta_n X/L)}{\delta_n + \sin\delta_n \cos\delta_n}\right) \quad (15)$$

and $$\delta_n \tan\delta_n = \frac{HL}{C'} = BI \quad (16)$$

where:

BI = Biot's Modulus = HL/C′
$\alpha$ = diffusivity of the metal = C′/DS
C′ = thermal conductivity of the metal
D = density of the metal
H = surface heat transfer coefficient
L = ½ the thickness of the section (for two-sided quench)
S = specific heat of the metal
$T_F$ = final temperature
$T_S$ = starting temperature
T(X,$t$) = temperature at time, $t$, and location, X
X = location in the web measured out from the center
$\delta_n$ = the n-th root of Equation (16)
$t$ = time after beginning of quench If $T_S$ is the temperature of the part at the beginning of the quench and $T_F$ its temperature at completion of the quench, then a plot of T(X,$t$) versus $t$ is the quench curve of the web at distance X from the center.

For the other variables, X and L are specified. The remaining two variables C′ and H are determined by fitting the equations to experimentally determined quench curves.

A computer program may be written to generate tables of T(X,$t$) versus $t$, as $t$ increases from zero. For example, time $t$ can be incremented in .01, .10, or 1.0-sec. steps depending on the anticipated rate of quench, among others things a function of L. For each trail set of quench conditions, a table of values can be generated and plotted on translucent graph paper. The experimental quench curve is plotted the same way to the same scale. The values of X, L, $T_S$, $T_F$, S, and D used in the computation of T(X,$t$) versus $t$ are the same as those used for the experimental quench. Trial values for H and C′ are selected. The two quench curves, i.e., the computed one and the experimental, are compared visually by laying one curve over the other. H and C′ are adjusted and a new table generated and plotted until the experimental curve is duplicated as closely as possible. Special attention is given to matching the slope of the experimental quench curves in the region where the critical time on the C-curve is the lowest for the particular alloy of interest.

It can be shown that for any given set of quench conditions with a high BI there is a distance X for which the quench curve changes very little over a wide range of C′ values. If an experimental quench curve is plotted for this value of X and an approximate value C′ is used, then it is necessary to adjust trail values of only H to fit the experimental curve.

It can also be shown that for any given set of quench conditions with a high BI and a large L that the quench curve at $X=0$ is primarily a function of diffusivity, $\alpha$. The product of density, D, and specific heat, S, change very little over a wide range of temperature; therefore, the variation of $\alpha$ or C′/DS with temperature, is largely dependent on C′. If an experimental quench curve of a thick web, say 3 in., is plotted for $X=0$ and an approximate value of H is used, it is necessary to adjust only trial values of C′ to fit the experimental curves. Using this trial and error procedure, a large number of experimental quench curves can be fitted.

It should be noted that Equations (15) and (16) assume that H and C′ are constant rather than temperature dependent. C′ is known to vary at least 10% over the quench range in the case of aluminum alloy 7075. The value of H changes during the quench as the water at the surface of the article begins with stable film boiling, changes to nucleate boiling, then to convection cooling. An evaluation that assumes H and C′ as constants represents an approximation; but for practical application, errors as high as ±10% (usually the error is lower) in these values still give usable results. There is no known general analytical solution to the differential equations that allow H and C′ to be functions of temperature.

By the above-described curve comparison, it is possible to obtain values of the surface heat transfer coefficient H for the various insulating materials which are available for reducing warpage, or tendency toward the same. An exemplary table of values for H is Table I.

The values in Table I were determined using 7075 aluminum alloy and a constant $C' = 92.5$ Btu/hr.ft.° F. Now, if it is desired to obtain a certain yield strength $\sigma$ in, for example, a web section, Equation (1) is used to determine an appropriate quench factor $\tau$ to give such as a $\sigma$. Then, assuming fixed L and C', trial values of H are selected from Table I, and Equations (16), (15), (12) and (11) or (2) are used to calculate $\tau$ for the chosen H values. In going from Equation (15) to Equation (12) it is customary to use $T_K = 5/9[T(X,t) + 460]$, since Equation (15) will ordinarily be evaluated in ° Fahrenheit while Equation (12) is in ° Kelvin. In this manner, one can determine an appropriate H for giving the desired value of $\sigma$. Then the insulation corresponding to the determined H value is applied to the section, and the article is solution heat treated and quenched.

Besides having the possibility of varying the surface heat transfer coefficient H, a section can be machined to vary the web thickness and thus the values of L in Biot's Modulus.

TABLE I

APPROXIMATE AVERAGE SURFACE HEAT TRANSFER COEFFICIENT FOR QUENCH INSULATING MATERIALS

| Material Description | H, Btu/Ft²*Hr*F |
|---|---|
| Johns-Manville Fireite Cement | |
| light coat (approx. 10 to 15 mils) | 1000 |
| heavy coat (approx. 30 to 40 mils) | 920 |
| Johns-Manville Fibrous Adhesive | |
| light coat (approx. 10 to 15 mils) | 640 |
| heavy coat (approx. 30 to 40 mils) | 220 |
| Burlington Industries Glass Cloth | |
| No.7500, weave 16 × 14, .0138 in. thick, 9.55 oz. per sq yd | 340 |
| No.1528, weave 42 × 32, .0070 in. thick, 5.95 oz. per sq yd | 240 |
| No.1510, weave 32 × 29, .0060 in. thick, 4.90 oz. per sq yd | 300 |

C.3. Computer Program

A computer program may be written to perform the integration in Equation (2) for the quench curve of Equation (15). The program may proceed as follows:

1. User loads the data for the alloy and quench conditions.
2. BI is calculated and a number of roots, $\delta_n$, are solved in Equation (16). Normally, only 8 roots are used, but more may be used, if desired. In general, more roots are required as BI increases.
3. Upper and lower temperatures are found that correspond approximately to critical times of $C_{\sigma_x} = 0.995\sigma_{max} = 10{,}000$ seconds.
4. The times from the beginning of quench are found for each of these upper and lower temperatures. These times are used to replace $t = 0$ and $t = \infty$ as the limits of integration in Equation (2).
5. Equation (2) is integrated numerically for any value of X to calculate the quench factor $\tau$ at the chosen X value. Commonly chosen values of X are $X = L$ (surface), $X = L/2$ (midpoint) and $X = 0$ (centerpoint). The average quench factor may be determined by integrating Equation (15) with respect to X and dividing by L to calculate the average temperature, T, through the web. The result is:

$$\frac{T_t - T_F}{T_S - T_F} = 2\sum_{n=1}^{n=\infty} \exp\left(\frac{-\delta_n^2 \alpha t}{L^2}\right) \frac{\sin^2\delta_n}{\delta_n^2 + \delta_n \sin\delta_n \cos\delta_n} \quad (17)$$

This "average" quench curve, Equation (17), is used together with Equation (16) in Equation (12) and thence in Equation (2) for the average quench factor from $X = 0$ to $X = L$. According to one preferred embodiment of the invention, insulation is applied to an oil-canning-susceptible web section to an extent such that the average quench factor in the web section is greater than the average quench factor in the surrounding rib sections, i.e., the ribs quench faster, in order to reduce overall warpage in the forging.

6. The quench factor is used in Equation (14) to estimate the yield strength. This program allows the mechanical properties to be calculated directly from the quench conditions.

EXAMPLES

Further illustrative of the present invention are the following examples:

EXAMPLE I

Figure 4:
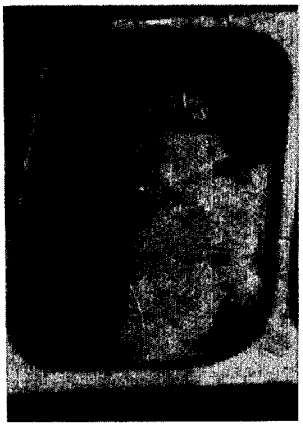
FIG. 4 is a photograph of one web section, with surrounding rib portions, of a forging as illustrated in FIG. 2 at a certain stage in a process according to the present invention.
Figure 5:
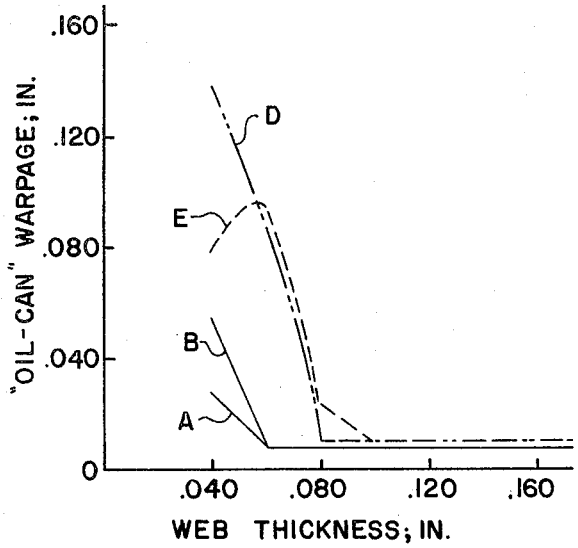
FIGS. 5 and 6 are graphs of "oil-can" warpage in inches versus web thickness in inches.
Figure 6:
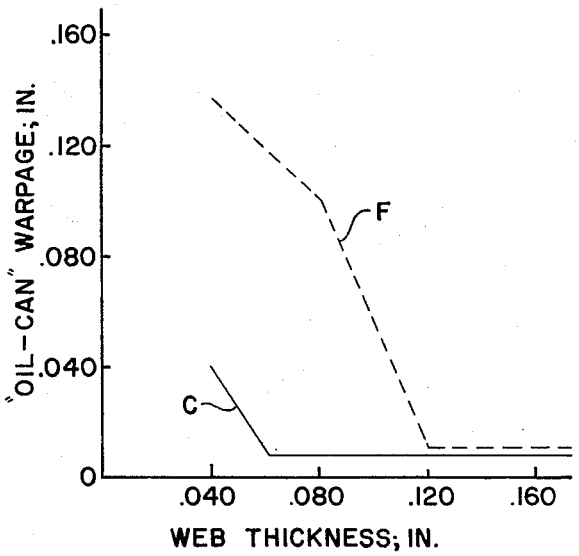

A forging, as illustrated in FIG. 2, of type 7075 aluminum alloy was subject to oil-canning when being machined to size. The forging had an overall length of 24½ inches, an overall width of 10 inches, a transverse rib 14 thickness of 1½ inches, a longitudinal rib 16 thickness of 1½ inches, and a web thickness of 0.622 inch. A yield strength of 60,000 psi in the web sections would be satisfactory. Using Equation (14) adjusted for T73 heat treat conditions (i.e., $\sigma_{max} = 63.6$ ksi), it is determined that a quench factor $\tau$ of 10.55 would give a yield strength of 60,321 psi. This would be satisfactory for a web section of the forging. Next, Equations (16), (15), (13), and (2) are used to determine which trial value of the Biot Modulus would give a quench factor of 10.55 at $X = 0$. Calculation using $X = 0$ is a conservative measure, because yield strength at $X = L/2$ and at $X = L$ should always be higher. With the Biot Modulus determined, suitable web thickness (2L) and average surface heat transfer coefficient (H) to give such modulus can be determined. Constants used in the various equations are: $T_S = 870°$ F; $T_F = 46°$ F; thermal conductivity $C' = 92.5$ BTU-ft/ft²-hr-° F; specific heat $S = 0.25$ BTU/lb-° F; density $D = 172.8$ lbs./ cu. ft.; and diffusivity $\alpha = 2.141$ ft²/hr. It is determined that a Biot Modulus of 0.05743 would give a quench factor of 10.55 for $X = 0$; the first eight roots of $\delta$ are 0.23759, 3.15977, 6.29229, 9.43087, 12.57101, 15.71164, 18.85256, and 21.99377. Since the integration of Equation (2) between $t_o = 0$ and $t_f =$ infinity would result in errors in the computer operation and is unnecessary, integration is carried out only between the bounds $C \quad = 11094$ seconds and 10508 seconds. The corresponding values of time t are, at a point halfway into the thickness of the web, i.e., $X = 0$, 0.579 seconds and 9.410 seconds. From Table I, an H value of 340 can be obtained by using Burlington Industries Glass Cloth No. 7500. Using this value in the formula for the Biot Modulus, it is determined that an appropriate halfthickness L would be 0.1875 inch, indicating that a web thickness of 0.375 or 3/8 inch should be used. The 0.622-inch webs in this Example were therefore premachined to provide a reduced web thickness of three-eights inch. Following premachining, the forging was immersed in hot water to float away as much of the machining oil as possible and then dipped into a nitric acid bath to get rid of any remaining oil. For the purpose of promoting bonding between an insulating cement and the premachined webs, the forging is then roughened by immersing it in a caustic soda bath for approximately 1 minute. This is followed by a rinse in water and a dip into a nitric acid bath to remove smut resulting in the caustic soda bath. The caustic soda bath was a 5 percent aqueous sodium hydroxide solution at 140 to 180° F. A suitable nitric acid bath is an aqueous solution containing 60 to 70 percent by weight nitric acid; temperature is the ambient temperature. The glass cloth was cut into panels matching the dimensions of the webs. These panels were secured to both sides of each web using Fireite cement at each of the four corners of every panel. The resulting assembly is illustrated in FIG. 4, the dark patches at the corners of the glass cloth being Fireite cement which has impregnated the glass cloth. The heavier weight No. 7500 cloth used in this Example has the advantage that attack on it by the sodium silicate in the cement is insignificant. The forging, insulated with glass cloth, was solution heat treated by leaving it in a furnace at 870° F overnight. The furnace heating first brought the forging to 870° F and then soaked the forging at this temperature. The quench was in a water bath at 46° F. Following this, the forgoing was agehardened to the T73 condition by bringing it to 225° F in 4 hours and holding it at the 225° F temperature for 6 hours. Then the forging was brought to 350° F in 4 hours, followed by holding at 350° F for 8 hours. The precipitation hardened forging was then machined, first to reduce the web thickness to .250 inch, the transverse rib 14 thickness to .250 inch, and the longitudinal rib thickness to .500 inch. Then the web was machined incrementally first to .200 inch, then in steps of 40 thousandths of an inch to .120 inch, and finally in steps of 20 thousandths of an inch to .40 inch. Maximum oil-canning deflection of the webs was measured after each incremental reduction in web thickness. Results are plotted as Curves A and B in FIG. 5 for the two side webs and as Curve C in FIG. 6 for the central web. mechanical properties also were determined using tensile specimens taken from the center of a side panel and having a tensile axis parallel to the side webs 14. The determined properties are given in Table II.

EXAMPLE II (A COMPARATIVE EXAMPLE)

For the purpose of providing a measure of the reduced oil-canning achieved according to the invention in Example I, a duplicate 7075 alloy forging was treated under exactly the same conditions as for Example I, except that (1) no insulation was used and (2) the web thickness was 0.622 inch during quenching. The oil-canning for the side webs is illustrated by Curves D and E in FIG. 5 and for the central web by Curve F in FIG. 6. The reduced oil-canning exhibited by treatment according to Example I is clear from a comparison of Curves A, B, and C with Curves D, E, and F. The mechanical properties for this comparative example are presented in Table II. Note that the yield strength is close to the maximum of 63,600 psi.

EXAMPLE III (STANDARD MINIMUM PROPERTIES)

Standard minimum mechanical properties for forgings as in ExamplesI and II have been extracted from Table 15.1 in ALUMINUM STANDARDS & DATA, the Aluminum Association, 1972–1973, are are presented in Table II. It is to be noted that, despite the insulation provided in Example I, minimum mechanical properties were, nevertheless, met.

EXAMPLE IV

Figure 7:
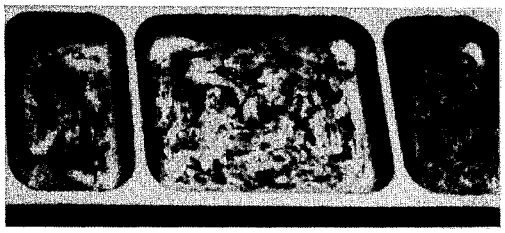
FIG. 7 is a photohgraph of a forging as in FIG. 2 at a certain stage in a process according to the present invention.
Figure 8:
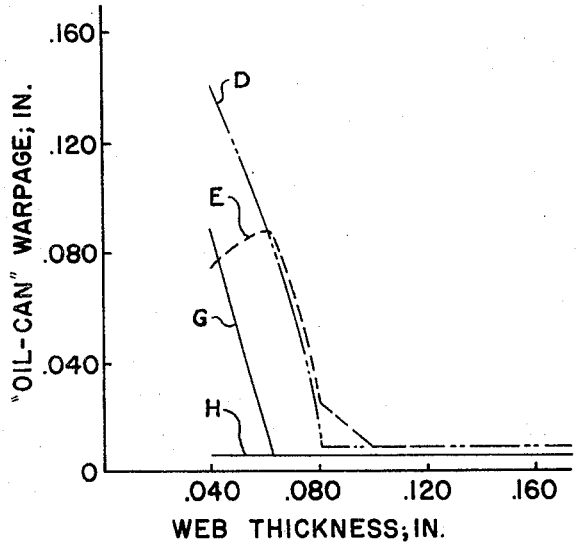
FIGS. 8 and 9 are graphs as in FIGS. 5 and 6.
Figure 9:
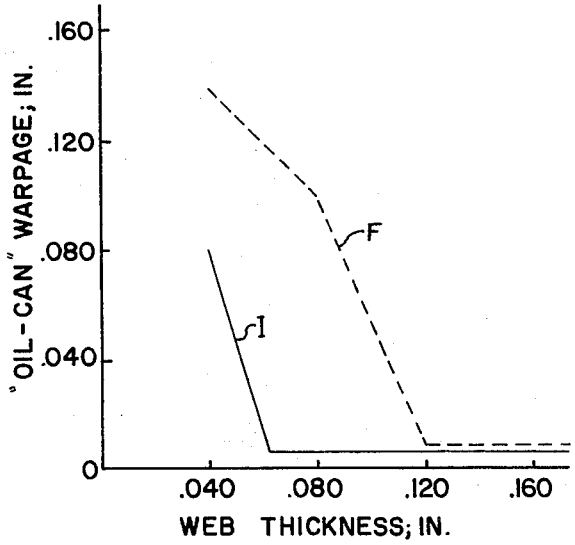

An aluminum alloy die forging as described in Example I was immersed in a caustic soda bath for about 5 minutes to remove the forging lubricant and to roughen the surface of the webs to promote bonding of insulation onto the webs. After rinsing, smut was removed by immersion in a nitric acid bath. The web thickness was 0.622 inch. In a potential use of the forging, a web yield strength of 58,500 psi would be acceptable. The same calculations as in Example I are gone through to give a quench factor of 16.12. This quench factor corresponds to a yield strength of 58,660 psi. Using parameters otherwise in Example I, a Biot Modulus of 0.10506 is determined by calculation to give this quench factor of 16.12. The eight solutions of $\delta$ are: 0.31884, 3.174611, 6.29991, 9.43595, 12.57472, 15.71466, 18.85510, and 21.99592. The integration of Equation (2) is carried out between $t = 0.779$ and 14.269 seconds at $x = 0$. The original 0.622-inch web thickness of the forging is used to determine L, the half-thickness, and the formula for the Biot Modulus is solved to yield an average heat transfer coefficient H of 375 as needed in the present instance to give a web yield strength of 58,660 psi. With reference to the data of Table I, it appears that a medium coat of Fibrous Adhesive could give the desired average surface heat transfer coefficient H. A coating of this adhesive was painted onto the web sections of the forging. The appearance of the coated web sections is shown in FIG. 7. It wll be noted that there is a variation in the thickness of the coating over the web sections, it being possible to see the aluminum metal in some areas while in other areas the coating is dense enough to hide the underlying aluminum. This variation in coating thickness does not play a significant role, probably due to the high thermal conductivity of the aluminum. It will be apparent, however, that the glass cloth used in Example I has the advantage over any painted insulation coating that a uniform, reproducible insulation coating thickness is achievable. After the water forming the base of the Fibrous Adhesive was dried, the forging was solution heat treated, quenched, and age hardened to the T73 condition as explained in Example I. Machining was likewise carried out in Example I. Maximum oil-canning deflection of the webs was measured and is presented as curves G and H in FIG. 8 for the two side webs and as curve I in FIG. 9 for the central web. Curves D, E, and F from Example II are provided in FIGS. 8 and 9 for the purpose of comparison. The reduced oil-canning obtained through insulation according to the present invention is again clear. Mechanical properties were also determined using specimens as explained in Example I. These properties are given in Table II. The yield strength $\delta$ is as desired and lies above the standard minimum properties of Example III.

Besides exhibiting reduced oil-canning, it was noted that the forging treated according to the present invention in this Example exhibited a greatly reduced overall warpage as based on its total length. It is believed that this reduced large-scale warpage is promoted by the fact that the insulation on the thinner web sections allowed the thicker rib sections to quench more quickly than the web sections. Using half-thickness L equals 0.75 inch, an average heat transfer coefficient of 2300 Btu/hr.ft.$^2$. ° F for bare aluminum in water, and other parameters as given in Example I yields an average (Equation 17) quench factor $\tau$ equal to 9.44 in the ribs, i.e., a value lower than the average quench factor, also 16.12, in the web of this Example, indicating faster quenching.

TABLE II

MECHANICAL PROPERTIES FOR FORGINGS OF EXAMPLES

| | Example | Mechanical Properties Tensile Strength (ksi) | Yield Strength (ksi) | Elong. (%) |
|---|---|---|---|---|
| I | (Present Invention) | 72.7 | 60.3 | 9.5 |
| II | (Comparison) | 71.4 | 63.5 | 5.0 |
| III | (Standard Minimum Properties) | | | |
| | — Parallel to grain flow | 66.0 | 56.0 | 7.0 |
| | — Transverse to grain flow | 62.0 | 53.0 | 3.0 |
| IV | (Present Invention) | 68.0 | 58.6 | 8.0 |

Example V

A forging, i.e., an airplane wing rib, made up of rib and web (numerous sizes and shapes up to about 18-inches maximum dimension) sections and having overall dimensions of 8-feet in length, 28 inches at its widest point, and 3 to 4 inches rib breadth, was treated according to the present invention for the purpose of reducing oil-canning in the web sections. After quenching, the forging was laid on a flat surface and one end of the forging purposely held flat. The other end was raised by overall warpage only about 1/16th of an inch, as compared to up to 2 inches of overall warpage which has resulted when no insulation was placed on the web sections.

Example VI

An extrusion, as illustrated in FIG. 10, of type 7075 aluminum alloy was subject to edge wave and bowing (center of curvature circle above in FIG. 10). The extrusion had an overall length of 26 feet, an overall width of 3.375 inches, and a depth of 1.354 inches. The thin wings 21*a* and 21*b* of 0.60 inch thickness were causing the distortion. A yield strength of 70,000 psi before stretching would be satisfactory. Using Equation (14) adjusted for T6511 heat treat conditions (i.e., $\sigma_{max} = 80.0$ ksi), it is determined that a quench factor $\tau$ of 2.14 would give a yield strength of 79,144. This would be satisfactory for the wing sections of the extrusion. Next, Equations (16), (15), (13), and (2) are used to determine which trial value of the Biot Modulus would give a quench factor of 2.14 at $x = 0$. Calculation using $X = 0$ is a conservative measure, because yield strength at $X = L/2$ and at $X = L$ should always be higher. With the Biot Modulus determined, suitable web thickness (2L) and average surface heat transfer coefficient (H) to give such modulus can be determined. Constants used in the various equations are: $T_x = 860°$ F; $T_F = 90°$ F; thermal conductivity $C' = 92.5$ BTU-ft/ft$^2$-hr-° F; specific heat S = 0.25 BTU/lb-° F; density D = 172.8 lbs./cu.ft.; and diffusivity $\alpha = 2.141$ ft$^2$/hr. It is determined that a Biot Modulus of 0.00676 would give a quench factor of 2.14 for $X = 0$; the first eight roots of $\delta$ are 0.08760, 3.14376, 6.28429, 12.56691, 15.70842, 18.84993, and 21.99144. Since the integration of Equation (2) between $t_o = 0$ and $t_f =$ infinity would result in errors in the computer operation and is unnecessary, integration is carried out only between the bounds C = 11095 seconds and 10509 seconds. The corresponding values of time t are, at a point halfway into the thickness of the wings, i.e., $X =$ 0, 0.086 seconds and 1.962 seconds. Using the Biot Modulus = 0.00676 determined above, the half thickness of the wings $L = .030$, the thermal conductivity $C' = 92.5$, and the Equation (16) for Biot Modulus, it is determined that a surface heat transfer coefficient, $H =$ 250, would be satisfactory. From Table I, an H of 250 can be obtained by using a medium to heavy coating of Johns-Manville Fibrous Adhesive. The wings were then coated directly, without cleaning, by applying the cement with a common two inch wide paint brush. The resulting assembly is then allowed to air dry at ambient room temperature for 24 hours or longer. The insulated extrusion was solution heat treated by placing it in a furnace at 860° F. The furnace heating first brought the extrusion to 860° F and then soaked the extrusion at this temperature for about 10 minutes. The quench was in a water bath at 90° F. Following this, the extrusion was longitudinally stretched to obtain 1-½% permanent set, then age hardened to the T6511 condition by bringing it to 250° F and holding it at this temperature for 24 hours. The precipitation hardened extrusion was free of both edge wave and bow. Mechanical properties also were determined, using tensile specimens taken from the treated sections, and are given in Table III. The specimens were exercised before stretching to obtain property values uneffected by work hardening caused by stretching. Stretching always increases the yield strength of this alloy, hence testing unstretched tends to err on the side of safety.

TABLE III

MECHANICAL PROPERTIES FOR EXAMPLE VI

| Specimen No. | Tensile Strength | Yield Strength | Percent Elongation |
|---|---|---|---|
| 1 | 85.5 ksi | 75.1 | 12.5 |
| 2 | 82.4 | 78.0 | — |
| 3 | 87.9 | 79.1 | 10.0 |
| 4 | 87.9 | 76.0 | 12.0 |
| 5 | 87.5 | — | 10.0 |
| 6 | 87.6 | — | 12.0 |

EXAMPLE VII

An extrusion, as illustrated in FIG. 11, of type 7075 aluminum alloy was subject to edge wave and bow from heat treatment. The extrusion had an overall length of 28 feet, an overall width of 4.3 inches, a mean height of 2.5 inches, and the cross section of a "T". A yield strength of 70,000 psi after stretching would be satisfactory. Using Equation (14) adjusted for T6511 heat treat conditions (i.e., $\sigma_{max} = 70.0$ ksi), it is determined that a quench factor $\tau$ of 4.04 would give a yield strength of 78,395 psi. This would be satisfactory for the extrusion. Next, Equations (16), (15), (13), and (2) are used to determine which trial value of the Biot Modulus would give a quench factor of 4.04 at $X = 0$. Calculation using $X = 0$ is a conversative measure, because yield strength at $X = L/2$ and at $X = L$ should always be higher. With the Biot Modulus determined, suitable stem thickness (2L) and average surface heat transfer coefficient (H) to give such modulus can be determined. Constants used in the various equations are: $T_S = 860°$ F; $T_F = 90°$ F; thermal conductivity $C' = 92.5$ BTU-ft/ft$^2$-hr-° F; specific heat $S = 0.25$ BTU/lb-° F; density $\cdot D = 172.8$ lbs./cu.ft.; and diffusivity $\alpha = 2.141$ ft$^2$/hr. It is determined that a Biot Modulus of 0.01126 would give a quench factor of 4.04 for $X = 0$; the first eight roots of $\delta$ are 0.10635, 3.14532, 6.28507, 9.42599, 12.56730, 15.70862, 18.85012, and 21.99163. Since the integration of Equation (2) between $t_o = 0$ and $t_f =$ infinity would result in errors in the computer operation and is unnecessary, integration is carried out only between the bounds $C = 11095$ seconds and 10509 seconds. The corresponding values of time $t$ are, at a point halfway into the thickness of the web, i.e., $X = 0$, 0.164 seconds and 3.699 seconds. Using the Biot Modulus = 0.01126 determined above, the half thickness of the stem, $L = .050$, the thermal conductivity $C' = 92.5$, and the Equation (16) for Biot Modulus, it is determined that a surface heat transfer coefficient, $H = 250$, would be satisfactory. From Table I, an $H$ of 250 can be obtained by using a medium to heavy coating of Johns-Manville Fibrous Adhesive. The stem was then coated using a common 2 inch wide paint brush and allowed to dry for 24 hours. The extrusion was solution heat treated by placing it in a furnace at 860° F. The furnace heating first brought the extrusion to 860° F and then soaked the extrusion at this temperature about 10 minutes. The quench was in a water bath at 90° F. At this point, the extrusion is bowed into a circular arc such that the flanges of the "T" are on the convex side, with the center of the arc lying below the extrusion in FIG. 11. This is contrary to what would result without the use of this invention wherein the flanges of the "T" would be on the concave side, with the center of curvature above in FIG. 11. The extrusion was then straightened by stretching to a permanent set of 1½% at which point its straightness was measured. The maximum deviation from straight was found to be 0.080 inches, whereas the allowable deviation is 0.150 inches. Another extrusion of the same shape, material and heat treatment but without the use of this invention exceeded allowable straightness deviation and could not be straightened within the allowable deviation when stretched to a permanent set of 4%, the maximum allowable stretch for this material. Following this, the extrusion was age-hardened to the T6511 condition by bringing it to 250° F and holding it at this temperature for 24 hours.

EXAMPLE VIII

The experiment of Example VII was repeated with the sole difference being that the extrusion used had recrystallization in the stem.

EXAMPLE IX

A precision casting, as illustrated in FIGS. 12 and 13, of type A357 aluminum alloy was subject to excessive distortion from heat treatment. The casting had an overall length of 75 inches, an overall width of 14½ inches, an overall depth of 4½ inches, and nominal web and edge thicknesses in edge 27 of 0.080 inch. This alloy is known to have a low sensitivity to quench rate, hence meeting guaranteed properties is not difficult. No "C" curve has been developed for A357 alloy.

The objective of the application of the invention is this example was to (1) reduce oil-canning in the web sections, (2) reduce wave in the longitudinal edge 27, (3) reduce twist and (4) reduce bow distortion, thereby decreasing the amount of manual straightening time required.

To achieve these objectives, a heavy coating of Johns-Manville Fibrous Adhesive was applied to (1) both sides of each of the webs, 29 through 36, (2) both sides of the longitudinal edge 27 and (3) to one side (the underside in FIGS. 12 and 13) of the curved plane of the casting in the area of the thickest part of the tubular section.

The insulating material was allowed to dry for 24 hours. The casting was then solution heat treated by placing it in a furnace for 15 hours at 1000° F followed by a quency in water at 90° F. The casting was then cooled and held to 0° F to retard aging. At a time convenient to the production schedule, the part was removed from the cooling chamber and manually straightened to within the allowable tolerance. The casting was then artificially aged by placing it in a furnace at 310° F for 3½ hours.

The casting treated in accordance with this invention required only slight manual straightening, as compared to when the casting is quenched without the use of the present invention. With the use of the present invention, edge wave was removed from 90% of the edge 27, oil-canning was totally eliminated, and, for all practical purposes, the casting conformed to the gage surface of the gage box 26. Some reduction in the bending of tube section 28 was also achieved.

It will be understood that the above description of the present invention is susceptible to various modifications, changes, and adaptations, and the same are intended to be comprehended within the meaning and range of equivalents of the appended claims.

What is claimed is:

1. A method for making a heat treated aluminum alloy article of reduced warpage or reduced tendency to warp during a possible machining step, comprising the steps of bonding insulation onto selected areas of the article with a bonding means for maintaining a bond during heating for solution heat treatment, solution heat treatment, solution heat treating the thus-insulated article, and, with the insulation still on the article, subjecting the solution heat treated article to a quench for maintaining precipitable components of the alloy in solution, and, subsequent to the quench, age-hardening the article.

2. A method as claimed in claim 1, wherein the article is an extrusion.

3. A method as claimed in claim 2, wherein the extrusion has recrystallized material.

4. A method as claimed in claim 1, wherein the insulation is applied, in the step of bonding, onto a thin edge section adjoining a thick section, for reducing edge wave in the thin edge section.

5. A method as claimed in claim 4, wherein the article is an extrusion.

6. A method as claimed in claim 5, wherein the thin edge section contains recrystallized material.

7. A method as claimed in claim 4, wherein the article is a casting.

8. A method as claimed in claim 1, wherein the article is a casting.

9. A method as claimed in claim 1, wherein the article is a plate.

* * * * *

UNITED STATES PATENT AND TRADEMARK OFFICE

CERTIFICATE OF CORRECTION

PATENT NO. : 3,996,075

DATED : December 7, 1976

INVENTOR(S) : Charles P. Furney, Jr. et al

It is certified that error appears in the above-identified patent and that said Letters Patent are hereby corrected as shown below:

| | |
|---|---|
| Column 1, line 7 | Change "3,393,954" to --393,954--. |
| Column 2, line 11 | Change "photohgraph" to --photograph--. |
| Column 2, line 40 | After "hardenable" insert --aluminum--. |
| Column 2, line 61 | Change "s" to --a--. |
| Column 3, lines 30 and 31 | Change "alui-num" to --alumi-num--. |
| Column 3, line 42 | Change "precpitation" to --precipitation--. |
| Column 4, line 21 | Change "notes" to --noted--. |
| Column 4, line 24 | After "that" insert --it--. |
| Column 4, line 58 | Change "surfce" to --surface--. |
| Column 5, line 39 | Change "Saureisen" to --Sauereisen--. |
| Column 5, line 49 | After "5.95" insert --ounces--. |

UNITED STATES PATENT AND TRADEMARK OFFICE
CERTIFICATE OF CORRECTION

PATENT NO. : 3,996,075
DATED : December 7, 1976
INVENTOR(S) : Charles P. Furney, Jr. et al It is certified that error appears in the above-identified patent and that said Letters Patent are hereby corrected as shown below:

| | |
|---|---|
| Column 6, lines 6 and 7 (equation (2)) | Change "$t_f$ / $t_o$" to $t_f$ / $t_o$. |
| Column 6, line 22 | Following the equation, insert --(3)--. |
| Column 6, line 42 | Change "logarithmm" to --logarithm--. |
| Column 6, line 52 | Change "$J \cdot K^{-} \cdot mol^{-}$" to --$J \cdot K^{-1} \cdot mol^{-1}$--. |
| Column 6, line 54 | Change "449-447" to --449-457--. |
| Column 7, line 1 (equation (6)) | Change "$t_f$ / $t_o$" to --$t_f$ / $t_o$--. |
| Column 7, line 14 (equation (7)) | After "1 -" insert --exp--. |
| Column 8, line 62 | Change "$\sigma/\sigma_{max}$" to --$\sigma_x/\sigma_{max}$--. |
| Column 10, line 6 | Change "trail" to --trial--. |

UNITED STATES PATENT AND TRADEMARK OFFICE

CERTIFICATE OF CORRECTION

PATENT NO. : 3,996,075

DATED : December 7, 1976

INVENTOR(S) : Charles P. Furney, Jr. et al

It is certified that error appears in the above-identified patent and that said Letters Patent are hereby corrected as shown below:

| | |
|---|---|
| Column 10, line 26 | Change "trail" to --trial--. |
| Column 11, line 6 | Delete "as". |
| Column 12, line 58 | Change "C" to --$C_{\sigma_x}$--. |
| Column 12, line 65 | Change "halfthickness" to --half-thickness--. |
| Column 13, line 1 | Change "three-eights" to --three-eighths--. |
| Column 13, line 31 | Change "forgoing" to --forging--. |
| Column 13, line 32 | Change "agehardened" to --age-hardened--. |
| Column 13, line 43 | Change ".40" to --.040--. |
| Column 13, line 48 | Change "mechanical" to --Mechanical--. |
| Column 14, line 5 | Change "ExamplesI" to --Examples I--. |
| Column 14, line 33 | After "average" insert --surface--. |

UNITED STATES PATENT AND TRADEMARK OFFICE

CERTIFICATE OF CORRECTION

PATENT NO. : 3,996,075

DATED : December 7, 1976

INVENTOR(S) : Charles P. Furney, Jr. et al

It is certified that error appears in the above-identified patent and that said Letters Patent are hereby corrected as shown below:

| | |
|---|---|
| Column 14, line 40 | Change "wll" to --will--. |
| Column 14, line 55 | After "out" insert --as--. |
| Column 15, line 49 | Change "0.60" to --0.060--. |
| Column 15, line 64 | Change "$T_X$" to --$T_S$--. |
| Column 16, line 2 | After "6.28429," insert --9.42560,--. |
| Column 16, line 7 | Change "C" to --$C_{\sigma_x}$-- |
| Column 16, line 48 | Change "exercised" to --excised--. |
| Column 17, line 11 | Change "conversative" to --conservative--. |
| Column 17, line 27 | Change "C" to --$C_{\sigma_x}$--. |

Signed and Sealed this

Twenty-second Day of March 1977

[SEAL]

*Attest:*

RUTH C. MASON
*Attesting Officer*

C. MARSHALL DANN
*Commissioner of Patents and Trademarks*

UNITED STATES PATENT AND TRADEMARK OFFICE

CERTIFICATE OF CORRECTION

PATENT NO. : 3,996,075

DATED : December 7, 1976

INVENTOR(S) : Charles P. Furney et al.

It is certified that error appears in the above-identified patent and that said Letters Patent are hereby corrected as shown below:

| | |
|---|---|
| Claim 1, Col. 18, lines 54-55 | After "treatment," delete "solution heat treatment,". |

Signed and Sealed this

Sixth Day of March 1979

[SEAL]

*Attest:*

RUTH C. MASON
*Attesting Officer*

DONALD W. BANNER
*Commissioner of Patents and Trademarks*